United States Patent [19]

Barnard

[11] 4,434,829

[45] Mar. 6, 1984

[54] COLLAPSIBLE YARD PAN

[76] Inventor: Robert L. Barnard, 8924 Cheltonham Pl., Annandale, Va. 22003

[21] Appl. No.: 296,567

[22] Filed: Aug. 26, 1981

[51] Int. Cl.[3] ..... B65B 67/12; B65D 77/00

[52] U.S. Cl. ..... 150/49; 248/99; 15/257.1; 294/1 R

[58] Field of Search ..... 150/49, 51, 1, 2; 15/257.1, 257.3, 257.6, 257.7; 248/99; 294/1 R, 1.1

[56] References Cited

U.S. PATENT DOCUMENTS

| | | | |
|---|---|---|---|
| 526,249 | 9/1894 | Meeker | 150/49 |
| 3,312,263 | 4/1967 | Wahlstrom | 150/2 |
| 3,747,653 | 7/1973 | Ringer | 150/49 X |
| 4,006,928 | 2/1977 | Beugin | 150/49 X |

*Primary Examiner*—William Price
*Assistant Examiner*—Sue A. Weaver
*Attorney, Agent, or Firm*—Burns, Doane, Swecker and Mathis

[57] ABSTRACT

The collapsible yard pan has a rigid frame covered with a pliable fabric or plastic film material contoured to form a portable bag container that can be opened along one side and an end which can lie flat for easy filling. The frame is typically a rectangular shaped double sided structure with two rigid primary side or top members supporting the opening edges of the bag. These two primary side members are hinged at the closed end of the bag, typically to a frame member that supports the bag closed end. This closed end member may be connected to a single rigid closed side or bottom edge support member. The edges of the open end of the bag are typically supported by either rigid or semi-rigid slats that assist in holding the bag end closed when the bag is closed. The slats on the leading edge of the bag also facilitate filling when loose material such as leaves or grass are raked or pushed into the open bag. When these slats are made semi-rigid, the bag may be end-emptied without opening the side by forcing the top and bottom edges together. This action will cause the semi-rigid slats to deflect and separate, allowing the contents of the bag to be emptied.

4 Claims, 3 Drawing Figures

FIG. 1
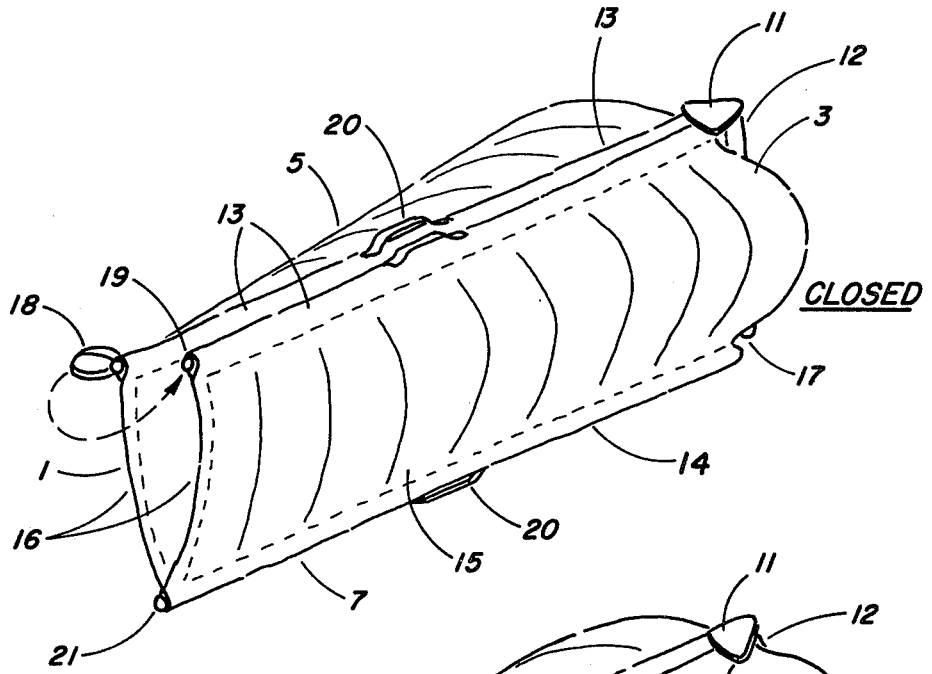
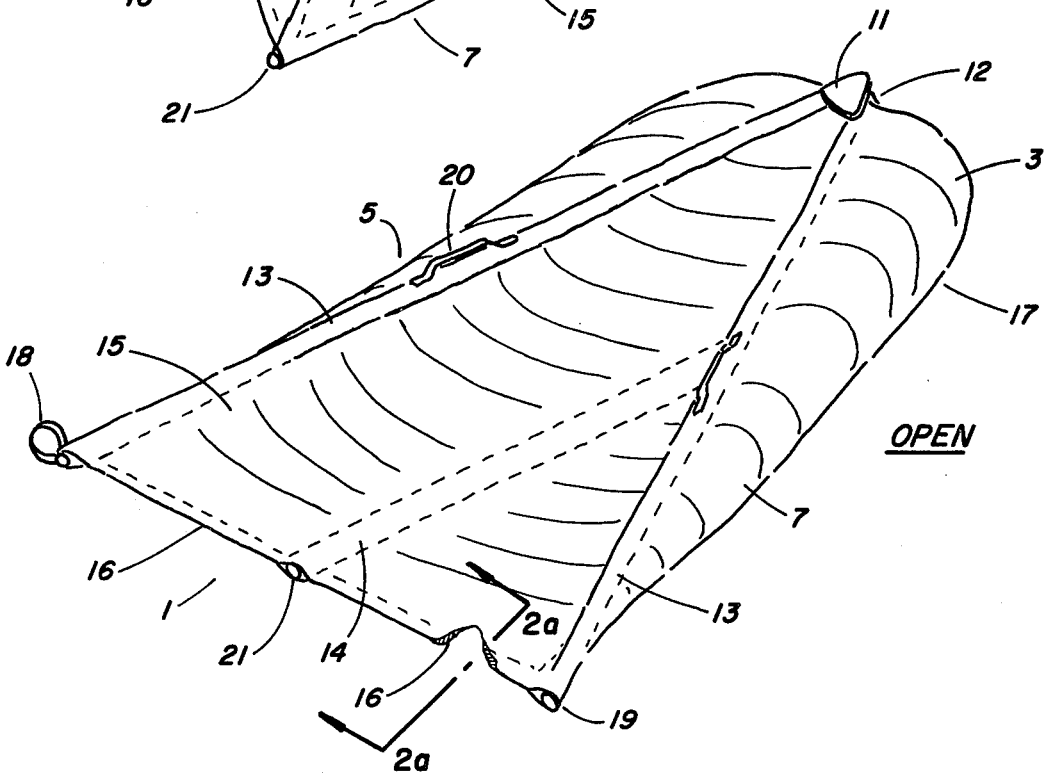
FIG. 2
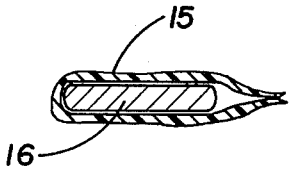
FIG. 2a

COLLAPSIBLE YARD PAN

FIELD OF THE INVENTION

The invention relates to bag-type containers that can be hinged open for convenient filling and then secured for storing or hauling the contents.

BACKGROUND OF THE INVENTION

Yard bags and garbage cans are among the simplest types of containers used to hold household rubbish, but they do not lend themselves to as easy or convenient collecting or filling with raked or swept loose materials such as leaves, grass cuttings, etc., as one might hope. For example, conventional yard bags are usually quite flexible and have no structural integrity beyond the strength of the fabric or plastic film material itself. As a consequence, filling of the bag is impeded by unwanted casual closing or partial closing of the bag. Garbage cans have a rigid opening, but typically the shape and/or size and/or location of the garbage can opening for filling in does not lend itself to easy and convenient filling with loose materials such as leaves or grass which have been raked or swept into a pile.

The search has continued, therefore, for improved containers or yard pans which do not incur or which substantially alleviate the problems and disadvantages of the prior art.

SUMMARY OF THE INVENTION

Accordingly, a primary object of the present invention is to provide a novel and improved container or yard pan which does not incur or which substantially alleviates the problems and disadvantages of the prior art. Another object of this invention is to provide a novel and improved container that can be completely opened in a flat, fixed posture for easy and convenient filling and then securably closed to captivate the contents for storage, hauling, etc., or, the contents can be conveniently emptied into another container.

In one aspect of the present invention, a collapsible or foldable portable container or yard pan is provided and which involves a filling or front end or portion and a closed or rear end or portion opposite and spaced apart from the filling end. Also involved is a filling or top side or edge substantially extending from the filling end to the closed end, as well as a closed or bottom side or edge opposite and spaced apart from the filling side. A pliable sheet enclosure is secured to a frame, with the sheet enclosure of a strength sufficient for holding the material or rubbish to be contained. The sheet enclosure extends or wraps about or over the closed end and about or over the closed side and is adapted to form a bag-like or pocket-like enclosure. The frame comprises a plurality, e.g., two or more,elongated or rod-like primary filling side frame members extending along the filling side and defining the filling side opening. The primary side frame members converge at a mutual hinge point or pivot area adjacent the closed end and are adapted to allow the container to open and to close along the filling side and to open and to close along the filling end. When the filling end is in an open position it lies substantially flat to facilitate loading and when in a closed position can be securably closed to contain any material therein.

In another aspect of the present invention, the edges of the filling end are supported by semi-rigid slats that assist in holding the filling end closed when the container is in a closed position. When these slats are made semi-rigid, the container or bag may be end-emptied without opening the side by forcing the top and bottom edge members together. This action will cause the semi-rigid slats to deflect and separate from each other, allowing the contents of the bag to be emptied.

The above described and other objects, aspects and advantages of the present invention will become more apparent from the following more detailed description, taken in conjunction with the accompanying illustrative drawings.

BRIEF DESCRIPTION OF THE DRAWINGS

FIG. 1 is a perspective view of the collapsible yard pan in a substantially closed position.

FIG. 2 is a perspective view of the collapsible yard pan in the open position for filling.

FIG. 2*a* is a cross-sectional view taken along line 2*a* in FIG. 2 of the open end frame members of collapsible yard pan.

DETAILED DESCRIPTION OF A PREFERRED BAG CONTAINER

As noted above, the collapsible, portable container or yard pan of the present invention is a pouch-shaped or bag-shaped enclosure fabricated from a pliable sheet material such as woven or non-woven fabric, e.g., cotton or nylon, or relatively thin plastic film material, e.g., polyethylene terephthalate, polyvinyl chloride or polyolefin. The container or bag may be held in an expanded or open position by a frame that is hinged open for easy and convenient filling and then closed to capture or secure the contents. The leading edge portions of the container or bag opening are held rigid by slats or frame members to accommodate filling when raking or pushing materials such as leaves or grass cuttings into the yard pan. Once filled, the bag can be closed and secured for storage or carrying.

With reference to FIGS. 1 and 2, a collapsible portable container or yard pan includes a filling or loading end 1 and a closed or back end 3 opposite and spaced apart from the filling end 1. A filling side 5 substantially extends from the filling end 1 to the closed end 3 and a closed side 7 is opposite and spaced apart from the filling side 5. A pliable sheet enclosure 15 is secured to the frame and extends about and encloses the closed end 3 and extends about and encloses the closed side 7 and is adapted to form a pocket-like or bag-like enclosure. The frame comprises a plurality of elongated primary filling side frame members 13 which extend along the filling side 5 and define the fillng side opening. The primary side frame members 13 converge at a mutual hinge point or pivot area 11 adjacent the closed end 3, and are adapted to allow the container to open and to close along the filling side 5 and to open and to close along the filling end 1. The filling end 1 when in an open position, as shown in FIG. 2, lies in a substantially flat plane to facilitate loading, i.e., raking or sweeping leaves or the like into the container. When in a closed position, as shown in FIG. 1, the material or contents within the container is securably contained.

Additionally, open end frame members 16 may be provided to rigidify leading edges of the filling end, thus facilitating filling of the container or yard pan. These open end frame members 16 converge as a second hinge or pivot point 21. Upon opening and closing of the container the open end frame members 16 will pivot about point 21.

Additionally, the collapsible yard pan or the container may be provided with a bottom frame member 14 which extends between the hinge point 21 and a third hinge or pivot point 17, so as to provide additional rigidification and strength to the bag or container.

If the open end frame members or slats 16 are constructed of a semi-rigid material, the container or bag may be emptied without opening the side 5 for forcing the top members 13 and bottom member 14 together. This action will cause the semi-rigid members of slats 16 to deflect and separate from each other, allowing the contents of the bag to be emptied.

Additionally, the collapsible container or yard pan may be provided with at least one elongated closed end frame member 12 extending along the closed end 3 and at an angle to the primary side frame members 13. This closed end frame member 12 may also converge to the hinge area 11.

A handle or handles 20 may be provided for carrying the container or bag. They may also facilitate emptying the filled container or bag into another container if desired. In this case, the handles 20 may provide a means for holding the container or bag in a vertical position while forcing the frame side members 13 and 14 together to open the bag end for emptying the contents.

The collapsible container or yard pan may also be provided with fastening means such as loop 18 and catch 19 to hold the filled bag closed for carrying and storing.

Frame members 12, 13, and 14 are relatively rigid members constructed from the same or different materials such as metal, wood, plastic, or cardboard. Frame members 16 may be of the same rigidity as members 12, 13, and 14 or they can be less rigid, i.e., semi-rigid slats. The semi-rigid slats 16 may be constructed from a resilient material with memory such as spring steel, a fiber base plastic or other suitable resilient material.

The frame members 12, 13, and 14 can be either physically fastened together and hinged at corner 11, or the members can be captured and held in position by the bag material 15. In this configuration, the resilient material will allow the two frame open side members 13 to be hinged open or closed. Frame member 12 supports the closed end of the bag and supports the hinge mechanism when side members 13 are physically hinged together. Member 14, which is optional, holds the open end bag edges in position while filling. Member 14 may be particularly advantageous when the feature of emptying the bag through the open end only is desired.

The bag enclosure 15 is constructed from pliable sheet fabric or film material and may be contoured so that the closed end 3 of the bag is generally cylindrically shaped to increase the bag volume or holding capacity.

The open or filling end bag edges are desirably held straight for easy filling by frame members 16 that are captured or held in the bag edge seams.

From the foregoing detailed description, it is apparent that a best mode for carrying out the present invention has been shown and described. However, it is also apparent that certain modifications and variations may be made without departing from the spirit and scope of the claimed subject matter as set forth in the accompanying claims hereinafter.

What is claimed is:

1. A collapsible, portable yard pan container comprising a filling end and a closed end opposite and spaced apart from the filling end; a filling side extending from the filling end to the closed end and a closed side opposite and spaced apart from the filling side; pliable sheet enclosure means secured to frame means, the sheet enclosure means of a strength sufficient for holding material to be contained and extending about the closed end and about the closed side and adapted to form a pocket-like enclosure, the frame means comprising a plurality of elongated, relatively rigid, rod-like primary filling side frame means extending along the filling side and defining a filling side opening, the primary side frame means being of sufficient rigidity to prevent unwanted casual closing of the container; the primary side frame means converging at a mutual hinge point at the closed end and adapted to allow the container to open completely along the filling side and to close along the filling side and to open and to close along the filling end, and adapted to allow the container to be held in a vertical position with the filling side closed and the filling end open for loading or emptying material therein; the filling end, when in an open position with the filling side also open, lying in a substantially flat plane to facilitate loading and when in a closed position securably containing any material therein and additionally comprising a plurality of elongated open end frame means converging at a second hinge point and adapted to facilitate filling of the yard pan and at least one elongated bottom frame member extending between the second hinge point and a third hinge point at the closed end.

2. A collapsible portable yard pan container comprising a filling end and a closed end opposite and spaced apart from the filling end;

a filling side substantially extending from the filling end to the closed end and a closed side opposite end spaced apart from the filling side;

pliable sheet enclosure means secured to frame means, the sheet enclosure means of a strength sufficient for holding material to be contained and extending about the closed end and about the closed side and adapted to form a pocket-like enclosure;

the frame means comprising a plurality of elongated primary filling side frame means extending along the filling side and defining a filling side opening;

the primary side frame means converging at a mutual hinged point adjacent the closed end and adapted to allow the container to open and to close along the filling side and to open and to close along the filling end, the filling end when in an open position lying in a substantially flat plane to facilitate loading and when in a closed position, securably containing any material therein; a plurality of elongated open end frame means converging at a second hinged point and adapted to facilitate filling of the yard pan;

at least one elongated bottom frame member extending between the second hinge point and a third hinge point at the closed end, the open end frame means being of a rigidity adapted to deflect outwardly from each other upon moving of the bottom member toward the side members, resulting in opening of the container at the filling end without allowing opening of the container along the filling side.

3. A collapsible yard pan container according to claim 2 additionally comprising at least one elongated closed end frame means extending along the closed end and at an angle to the primary side frame means and also converging at the mutual hinge point adjacent the closed end of the container.

4. A collapsible, portable yard pan container comprising a filling end and a closed end opposite and spaced apart from the filling end; a filling side extending from the filling end to the closed end and a closed side opposite and spaced apart from the filling side; pliable sheet enclosure means secured to frame means, the sheet enclosure means of a strength sufficient for holding material to be contained and extending about the closed end and about the closed side and adapted to form a pocket-like enclosure; the frame means comprising a plurality of elongated, relatively rigid, rod-like primary filling side frame means extending along the filling side and defining a filling side opening, the primary side frame means being of sufficient rigidity to prevent unwanted casual closing of the container; the primary side frame means converging at a mutual hinge point at the closed end and adapted to allow the container to open completely along the filling side and to close along the filling side and to open and to close along the filling end, and adapted to allow the container to be held in a vertical position with the filling side closed and the filling end open for loading or emptying material therein; the filling end, when in an open position with the filling side also open, lying in a substantially flat plane to facilitate loading and when in a closed position securably containing any material therein and adapted for conveniently collecting loose materials by raking or pushing materials into an open bag container, closing and securing the container for storing the contained materials and for emptying the materials into a confined opening by compressing the side frame means together to open the bag end; and wherein the side frame means further comprise a double sided rectangular shaped frame, and wherein the frame means are captured and held in position by the pliable plastic container material; and wherein said double sided frame is covered by the plastic material and has semi-cylindrical contoured sides forming a generally cylindrically shaped bag container when closed.

* * * * *